US009099790B2

(12) United States Patent
Chen et al.

(10) Patent No.: US 9,099,790 B2
(45) Date of Patent: Aug. 4, 2015

(54) MOBILE DEVICE AND ANTENNA STRUCTURE THEREIN

(71) Applicant: HTC Corporation, Taoyuan, Taoyuan County (TW)

(72) Inventors: Ju-Hung Chen, Taoyuan (TW); Pei-Ling Teng, Taoyuan (TW); Yi-Chun Chen, Taoyuan (TW); Tun-Yuan Tsou, Taoyuan (TW); Kuo-Cheng Chen, Taoyuan (TW)

(73) Assignee: HTC CORPORATION, Taoyuan (TW)

( * ) Notice: Subject to any disclaimer, the term of this patent is extended or adjusted under 35 U.S.C. 154(b) by 286 days.

(21) Appl. No.: 13/728,583

(22) Filed: Dec. 27, 2012

(65) Prior Publication Data

US 2014/0184453 A1 Jul. 3, 2014

(51) Int. Cl.

| | |
|---|---|
| ***H01Q 1/24*** | (2006.01) |
| ***H01Q 21/00*** | (2006.01) |
| ***H01Q 13/16*** | (2006.01) |
| ***H01Q 5/371*** | (2015.01) |

(52) U.S. Cl.

CPC ..... *H01Q 21/00* (2013.01); *H01Q 1/243* (2013.01); *H01Q 5/371* (2015.01); *H01Q 13/16* (2013.01); *Y10T 29/49016* (2015.01)

(58) Field of Classification Search

CPC ..... H01Q 1/243; H01Q 13/10; H01Q 13/16

USPC ..... 343/702, 767

See application file for complete search history.

(56) References Cited

U.S. PATENT DOCUMENTS

| | | | | |
|---|---|---|---|---|
| 6,618,020 | B2 | 9/2003 | Wang et al. | |
| 6,677,907 | B2 | 1/2004 | Shoji et al. | |
| 6,712,983 | B2 | 3/2004 | Zhao et al. | |
| 7,327,234 | B2 | 2/2008 | Egami et al. | |
| 7,518,564 | B2 | 4/2009 | Guthrie | |
| 7,551,142 | B1 * | 6/2009 | Zhang et al. | 343/702 |
| 8,325,094 | B2 * | 12/2012 | Ayala Vazquez et al. | 343/702 |
| 2009/0153412 | A1 * | 6/2009 | Chiang et al. | 343/702 |
| 2009/0256757 | A1 * | 10/2009 | Chiang et al. | 343/702 |
| 2011/0006953 | A1 * | 1/2011 | Chiang et al. | 343/702 |
| 2013/0082884 | A1 * | 4/2013 | Gummalla | 343/702 |

* cited by examiner

*Primary Examiner* — Hoang V Nguyen

(74) *Attorney, Agent, or Firm* — Birch, Stewart, Kolasch & Birch, LLP

(57) ABSTRACT

A mobile device includes a ground element, a conductive bezel, a nonconductive layer, and a feeding element. The conductive bezel is substantially independent of the ground element. A slot is formed in the conductive bezel. The nonconductive layer is affixed to the conductive bezel and covers the slot of the conductive bezel. The feeding element is close to the slot of the conductive bezel and is coupled to a signal source. An antenna structure is formed by the feeding element and the slot.

24 Claims, 6 Drawing Sheets

MOBILE DEVICE AND ANTENNA STRUCTURE THEREIN

BACKGROUND OF THE INVENTION

1. Field of the Invention

The subject application generally relates to a mobile device, and more particularly, relates to a mobile device comprising an antenna structure.

2. Description of the Related Art

With the progress of mobile communication technology, mobile devices, for example, notebook computers, tablet computers, mobile phones, multimedia players, and other hybrid functional portable devices, have become more common. To satisfy the demand of users, mobile devices usually can perform wireless communication functions. Some devices cover a large wireless communication area, for example, mobile phones use 2G, 3G, LTE (Long Term Evolution) and 4G systems and use frequency bands of 700 MHz, 850 MHz, 900 MHz, 1800 MHz, 1900 MHz, 2100 MHz, 2300 MHz, and 2500 MHz. Some devices cover a small wireless communication area, for example, mobile phones use Wi-Fi, Bluetooth, and WiMAX (Worldwide Interoperability for Microwave Access) systems and use frequency bands of 2.4 GHz, 3.5 GHz, 5.2 GHz, and 5.8 GHz.

An antenna of a mobile device is an important component for wireless communication. The radiation performance of an antenna tends to be influenced by other metal components (e.g., a battery, or a conductive bezel) of a mobile device. Generally speaking, a conventional slot antenna and a signal line thereof (i.e., a feeding element) have a same reference ground plane (e.g., a PCB (Printed Circuit Board)). Accordingly, a large area of a clearance region on the ground plane is required to maintain good antenna efficiency. This also increases the difficulty of designing a mobile device, because, so many electronic components must be disposed in a limited space.

BRIEF SUMMARY OF THE INVENTION

In one exemplary embodiment, the subject application is directed to a mobile device, comprising: a ground element; a conductive bezel, substantially independent of the ground element, wherein a slot is formed in the conductive bezel; a nonconductive layer, affixed to the conductive bezel, and covering the slot of the conductive bezel; and a feeding element, wherein the feeding element is close to the slot of the conductive bezel and is coupled to a signal source, wherein an antenna structure is formed by the feeding element and the slot.

In another exemplary embodiment, the subject application is directed to a method for manufacturing a mobile device, comprising the steps of: providing a ground element; providing a conductive bezel, wherein the conductive bezel is substantially independent of the ground element, and a slot is formed in the conductive bezel; affixing a nonconductive layer to the conductive bezel to cover the slot of the conductive bezel; and providing a feeding element, wherein the feeding element is close to the slot of the conductive bezel, the feeding element is coupled to a signal source, and an antenna structure is formed by the feeding element and the slot.

BRIEF DESCRIPTION OF DRAWINGS

The subject application can be more fully understood by reading the subsequent detailed description and examples with references made to the accompanying drawings, wherein.

DETAILED DESCRIPTION OF THE INVENTION

In order to illustrate the purposes, features and advantages of the subject application, the embodiments and figures thereof in the subject application are shown in detail as follows.

Figure 1:
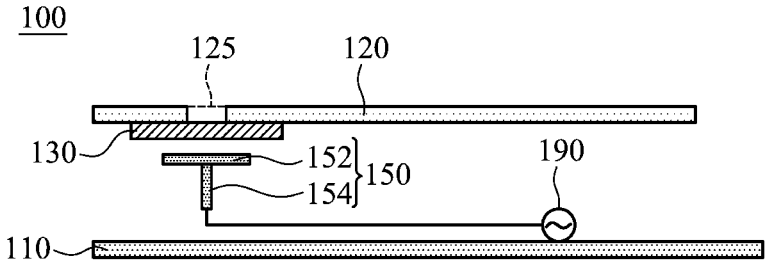
FIG. 1 is a side view for illustrating a mobile device according to an embodiment of the invention.
Figure 2:
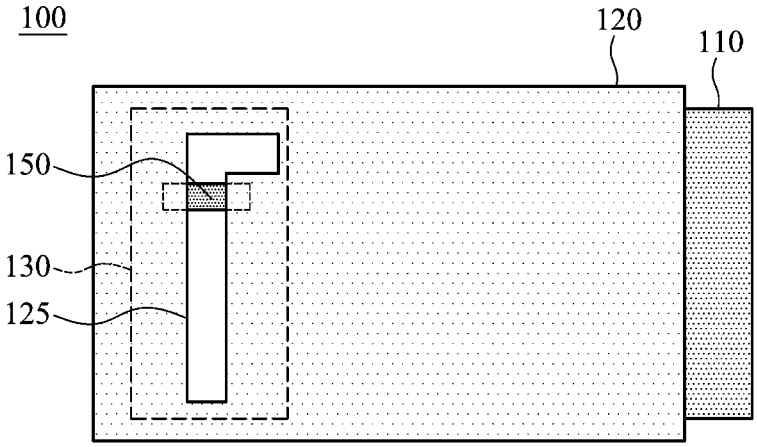
FIG. 2 is a top view for illustrating a mobile device according to an embodiment of the invention.

FIG. 1 is a side view for illustrating a mobile device 100 according to an embodiment of the invention. FIG. 2 is a top view for illustrating the mobile device 100 according to an embodiment of the invention. The mobile device 100 may be a smart phone, a tablet computer, or a notebook computer. As shown in FIG. 1 and FIG. 2, the mobile device 100 comprises a ground element 110, a conductive bezel 120, a nonconductive layer 130, and a feeding element 150. In some embodiments, the ground element 110, the conductive bezel 120, and the feeding element 150 are made of metal, such as aluminum, copper, or silver, and the nonconductive layer 130 is made of waterproof or dust-proof material, such as plastic material. Note that the mobile device 100 may further comprise other essential components, for example, a processor, a touch and display module, an RF (Radio Frequency) module, a power supply module, and a housing (not shown).

The conductive bezel 120 is substantially independent of the ground element 110. A slot 125 is formed in the conductive bezel 120. In some embodiments, at least a portion of a housing (not shown) of the mobile device 100 is formed by the conductive bezel 120, and the other components of the mobile device 100 are all disposed inside the housing. The shape of the slot 125 is not restricted in the subject application. For example, the slot 125 may substantially have an L-shape or an I-shape. The nonconductive layer 130 is affixed to the conductive bezel 120, and covers the slot 125 of the conductive bezel 120. The nonconductive layer 130 is configured to prevent water or dust from entering the mobile device 100 through the slot 125 of the conductive bezel 120. In a preferred embodiment, an antenna structure, such as a slot antenna, is formed by the feeding element 150 and the slot 125 on the conductive bezel 120. The antenna structure may operate in any band, for example, a DTV (Digital Television) band, a GPS (Global Positioning System) band, a Div (Diversity) band, a Bluetooth band, a Wi-Fi band, a WLAN (Wireless Local Area Network) band, and/or a telecommunication protocol band. The telecommunication protocol may be, for example, WCDMA, CDMA2000, CDMA, and GSM, etc. The feeding element 150 is close to the slot 125 of the conductive bezel 120, and is coupled to a signal source 190 such that a feeding signal is fed into the feeding element 150 to excite the antenna structure. The impedance matching of the antenna structure is controlled by adjusting a coupling distance between the feeding element 150 and the slot 125. To increase bandwidth of the antenna structure, the feeding element 150 should be away from a geometric center of the slot 125 of the conductive bezel 120, and may be close to one end of the slot 125. In some embodiments, the feeding element 150 may be further configured as a monopole antenna independently. The monopole antenna and the antenna structure may operate in different bands. For example, the monopole antenna covers a WLAN band, and the antenna structure covers a GPS band.

More particularly, the feeding element 150 comprises a feeding board 152 and a feeding connection element 154. The feeding board 152 is close to the slot 125 of the conductive bezel 120. The signal source 190 is coupled through the feeding connection element 154 to the feeding board 152. In some embodiments, the feeding board 152 is substantially parallel to the conductive bezel 120, and the feeding connection element 154 is substantially perpendicular to the feeding board 152. The feeding board 152 may be a metal board or an FPCB (Flexible Printed Circuit Board). The feeding connection element 154 may be a metal spring or a pogo pin. Note that the subject application is not limited to the above. Other feeding structures, such as a microstrip line or a coplanar waveguide, may be configured to feed in the antenna structure.

In the subject application, the conductive bezel 120 is considered as another ground plane independent of the ground element 110. Since the conductive bezel 120 is a portion of the antenna structure, the conductive bezel 120 does not negatively affect the radiation performance of the antenna structure. According to measurements, even if some electronic components (e.g., a battery) are disposed on the ground element 110 or a user holds the mobile device 100 by his hand, the radiation performance of the antenna structure will not be degraded much. The slot and the feeding element of the subject application have respective ground planes, and a large area for a clearance region for the antenna structure is not required. This further reduces the total size of the mobile device 100 and maintains good antenna efficiency.

Figure 3:
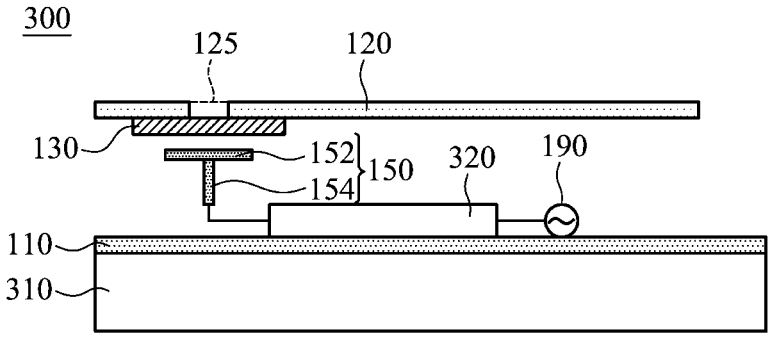
FIG. 3 is a side view for illustrating a mobile device according to an embodiment of the invention.

FIG. 3 is a side view for illustrating a mobile device 300 according to an embodiment of the invention. FIG. 3 is similar to FIG. 1. The difference between the two embodiments is that the mobile device 300 further comprises a dielectric substrate 310 and a coaxial cable 320. The dielectric substrate 310 may be an FR4 substrate. In the embodiment, the ground element 110 is a ground plane disposed on the dielectric substrate 310, and the ground plane is substantially parallel to the conductive bezel 120. The coaxial cable 320 is disposed on the ground plane. The signal source 190 is coupled through the coaxial cable 320 to the feeding element 150. Other features of the mobile device 300 of FIG. 3 are similar to those of the mobile device 100 of FIG. 1. Accordingly, the two embodiments can achieve similar performances.

Figure 4:
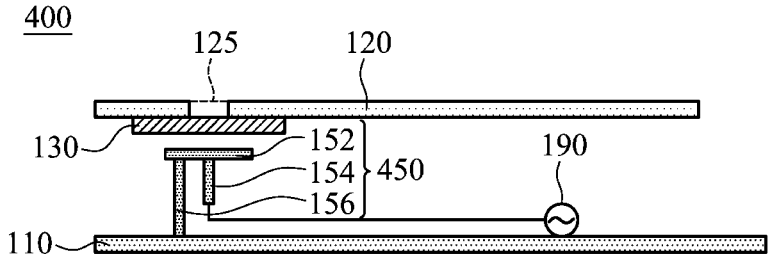
FIG. 4 is a side view for illustrating a mobile device according to an embodiment of the invention.

FIG. 4 is a side view for illustrating a mobile device 400 according to an embodiment of the invention. FIG. 4 is similar to FIG. 1. The difference between the two embodiments is that a feeding element 450 of the mobile device 400 further comprises a shorting connection element 156, and that the feeding board 152 is further coupled through the shorting connection element 156 to the ground element 110. The shorting connection element 156 may be a metal spring or a pogo pin. The shorting connection element 156 is configured to adjust the input impedance of the antenna structure of the mobile device 400. In some embodiments, the feeding element 450 may be further configured as a PIFA (Planar Inverted F antenna) independently. The PIFA and the antenna structure may operate in different bands. For example, the PIFA covers a WLAN band, and the antenna structure covers a GPS band. Other features of the mobile device 400 of FIG. 4 are similar to those of the mobile device 100 of FIG. 1. Accordingly, the two embodiments can achieve similar performances.

Figure 5:
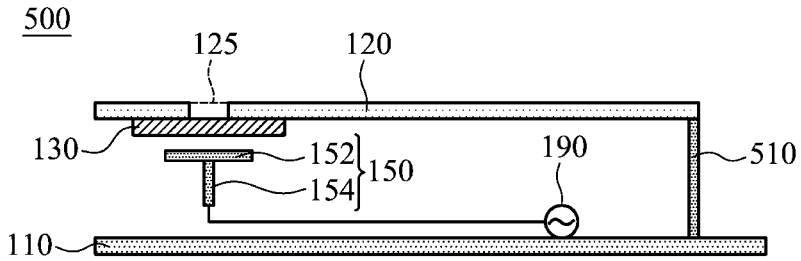
FIG. 5 is a side view for illustrating a mobile device according to an embodiment of the invention.

FIG. 5 is a side view for illustrating a mobile device 500 according to an embodiment of the invention. FIG. 5 is similar to FIG. 1. The difference between the two embodiments is that the mobile device 500 further comprises a grounding connection element 510, and that the conductive bezel 120 is further coupled through the grounding connection element 510 to the ground element 110. Note that the junction area of the grounding connection element 510 (the junction area means the overlapping area through which the grounding connection element 510 overlaps with the conductive bezel 120 or the ground element 110) is much smaller than a total area of the conductive bezel 120 and is much smaller than a total area of the ground element 110. Accordingly, the conductive bezel 120 and the ground element 110 may be still considered as two ground planes which are almost independent of each other. That is, the slot and the feeding element have their respective ground planes. In the embodiment, the mobile device 500 comprising the grounding connection element 510 not only meets the requirements of EMC (Electromagnetic Compatibility) but also adjusts the resonant frequency of the antenna structure. However, the grounding connection element 510 is not an essential component. The connection position of the grounding connection element 510 is adjustable according to different requirements. Other features of the mobile device 500 of FIG. 5 are similar to those of the mobile device 100 of FIG. 1. Accordingly, the two embodiments can achieve similar performances.

Figure 6:
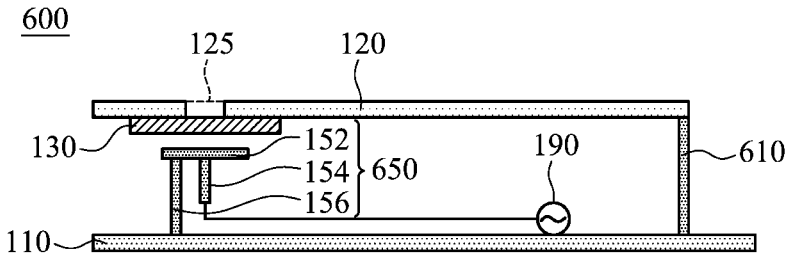
FIG. 6 is a side view for illustrating a mobile device according to an embodiment of the invention.

FIG. 6 is a side view for illustrating a mobile device 600 according to an embodiment of the invention. FIG. 6 is similar to FIG. 5. The difference between the two embodiments is that a feeding element 650 of the mobile device 600 further comprises a shorting connection element 156, and that the feeding board 152 is further coupled through the shorting connection element 156 to the ground element 110. Similarly, the feeding element 650 may be further configured as a PIFA independently, and the PIFA and the antenna structure of the mobile device 600 may operate in different bands. Other features of the mobile device 600 of FIG. 6 are similar to those of the mobile device 500 of FIG. 5. Accordingly, the two embodiments can achieve similar performances.

Figure 7:
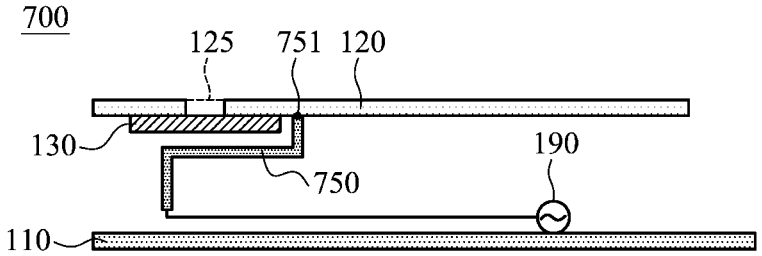
FIG. 7 is a side view for illustrating a mobile device according to an embodiment of the invention.

FIG. 7 is a side view for illustrating a mobile device 700 according to an embodiment of the invention. FIG. 7 is similar to FIG. 1. The difference between the two embodiments is that a feeding element 750 of the mobile device 700 is further directly coupled to a feeding point 751 on the conductive bezel 120. The feeding point 751 is close to the slot 125 of the conductive bezel 120. When the feeding element 750 is directly coupled to the conductive bezel 120, a coupling distance between the feeding element 750 and the slot 125 may be adjusted freely without affecting the radiation performance of the antenna structure of the mobile device 700. In the embodiment, the antenna structure may be considered as a hybrid antenna. That is, the slot 125 and the conductive bezel 120 may be respectively used to generate different resonant frequencies. Since the conductive bezel 120 is a portion of the antenna structure, the conductive bezel 120 does not affect the radiation performance of the antenna structure much. Similarly, the slot 125 and the feeding element 750 have their respective ground planes. Other features of the mobile device 700 of FIG. 7 are similar to those of the mobile device 100 of FIG. 1. Accordingly, the two embodiments can achieve similar performances.

Figure 8:
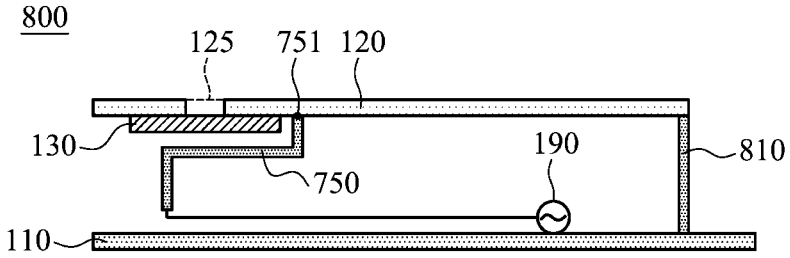
FIG. 8 is a side view for illustrating a mobile device according to an embodiment of the invention.

FIG. 8 is a side view for illustrating a mobile device 800 according to an embodiment of the invention. FIG. 8 is similar to FIG. 7. The difference between the two embodiments is that the mobile device 800 further comprises a grounding connection element 810, and that the conductive bezel 120 is further coupled through the grounding connection element 810 to the ground element 110. Similarly, the junction area of the grounding connection element 810 is much smaller than a total area of the conductive bezel 120 and is much smaller than a total area of the ground element 110 such that the slot 125 and the feeding element 750 have their respective ground planes. Other features of the mobile device 800 of FIG. 8 are similar to those of the mobile device 700 of FIG. 7. Accordingly, the two embodiments can achieve similar performances. In the embodiment, the mobile device 800 comprising the grounding connection element 810 not only meets the requirements of EMC but also adjusts the resonant frequency of the antenna structure. However, the grounding connection element 810 is not an essential component. The connection position of the grounding connection element 810 is adjustable according to different requirements.

As a matter of fact, the slot 125 of the conductive bezel 120 may have a variety of shapes, for which, corresponding embodiments will be described in reference to FIGS. 9A-9C.

Figure 9A:
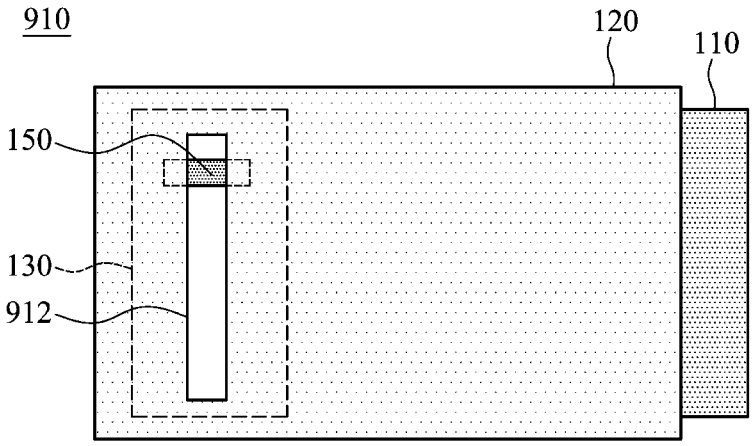
FIG. 9A is a top view for illustrating a mobile device according to an embodiment of the invention.

FIG. 9A is a top view for illustrating a mobile device 910 according to an embodiment of the invention. As shown in FIG. 9A, a slot 912 is formed in a conductive bezel 120 of the mobile device 910, and has a coupling distance to a feeding element 150. In the embodiment, the slot 912 substantially has an I-shape, and has two closed ends. Accordingly, the antenna structure of the mobile device 910 can operate in a high frequency band.

Figure 9B:
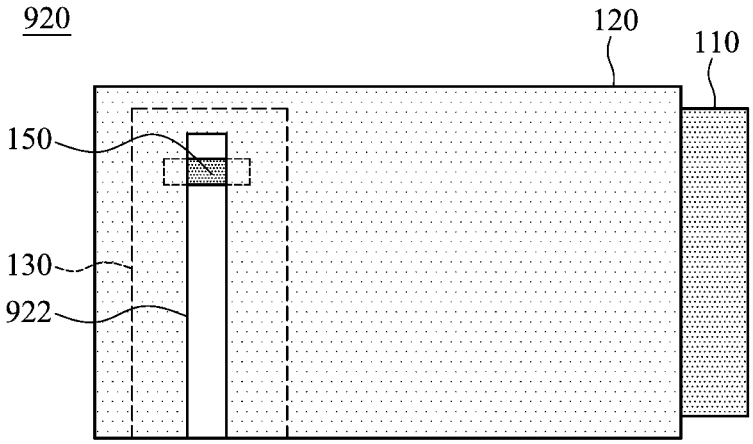
FIG. 9B is a top view for illustrating a mobile device according to an embodiment of the invention.

FIG. 9B is a top view for illustrating a mobile device 920 according to an embodiment of the invention. As shown in FIG. 9B, a slot 922 is formed in a conductive bezel 120 of the mobile device 920, and has a coupling distance to a feeding element 150. In the embodiment, the slot 922 substantially has an I-shape, and has an open end and a closed end. Accordingly, the antenna structure of the mobile device 920 can operate in a low frequency band.

Figure 9C:
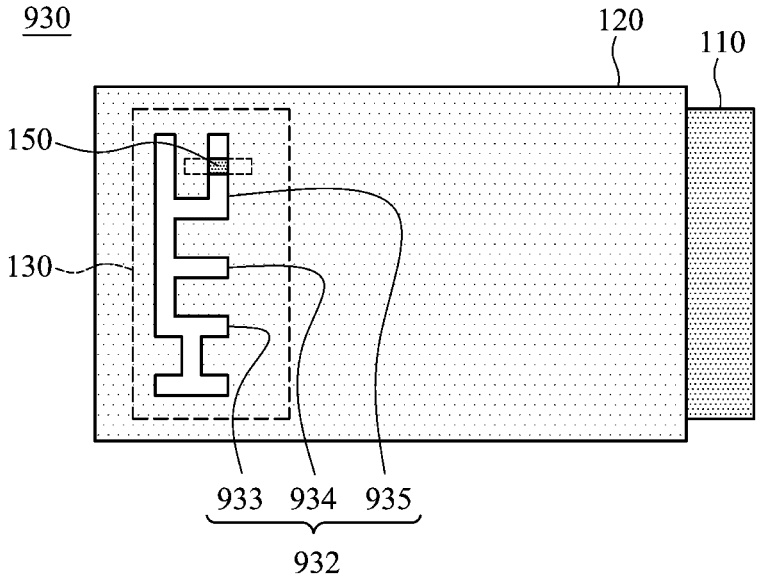
FIG. 9C is a top view for illustrating a mobile device according to an embodiment of the invention.

FIG. 9C is a top view for illustrating a mobile device 930 according to an embodiment of the invention. As shown in FIG. 9C, a slot 932 is formed in a conductive bezel 120 of the mobile device 930, and has a coupling distance to a feeding element 150. In the embodiment, the slot 932 is configured to display a company logo. For example, the slot 932 of the conductive bezel 120 comprises a first portion 933, a second portion 934, and a third portion 935. The first portion 933 substantially has an H-shape. The second portion 934 substantially has a T-shape. The third portion 935 substantially has a C-shape. By adjusting the relative positions of the feeding element 150 and the slot 932, for example, by feeding in the antenna structure at different positions of the first portion 933, the second portion 934, or the third portion 935, more resonant frequencies may be accordingly excited to generate multi-band operation modes. Note that the subject application is not limited to the above. Any kind of company logos, words, or patterns may be displayed on a surface of the mobile device 930 via the slot 932 of the conductive bezel 120.

Figure 10:
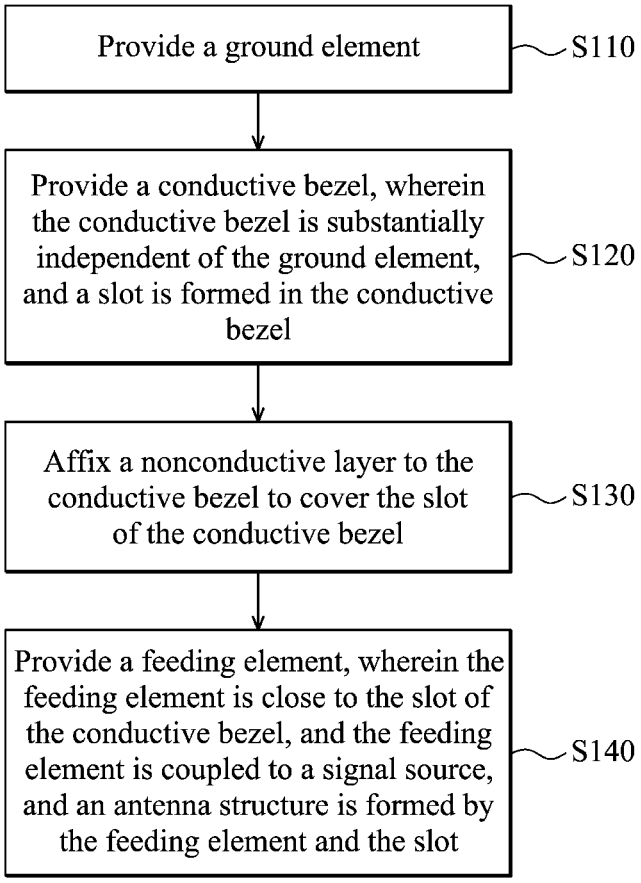
FIG. 10 is a flowchart for illustrating a method for manufacturing a mobile device according to an embodiment of the invention.

FIG. 10 is a flowchart for illustrating a method for manufacturing a mobile device according to an embodiment of the invention. To begin, in step S110, a ground element is provided. In step S120, a conductive bezel is provided, wherein the conductive bezel is substantially independent of the ground element, and a slot is formed in the conductive bezel. In step S130, a nonconductive layer is affixed to the conductive bezel to cover the slot of the conductive bezel. Finally, in step S140, a feeding element is provided, wherein the feeding element is close to the slot of the conductive bezel, the feeding element is coupled to a signal source, and an antenna structure is formed by the feeding element and the slot. Note that the foregoing steps are not required to be performed in order, and that every detailed feature of all of the above embodiments may be applied to the method.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A mobile device, comprising:

a ground element;

a conductive bezel, substantially independent of the ground element, wherein a slot is formed in the conductive bezel;

a nonconductive layer, affixed to the conductive bezel, and covering the slot of the conductive bezel; and a feeding element, wherein the feeding element is close to the slot of the conductive bezel and is coupled to a signal source, wherein an antenna structure is formed by the feeding element and the slot, and wherein both of the feeding element and the conductive bezel are configured to transceive a frequency band.

2. The mobile device as claimed in claim 1, wherein at least a portion of a housing of the mobile device is formed by the conductive bezel.

3. The mobile device as claimed in claim 1, wherein the nonconductive layer is configured to prevent water or dust from entering the mobile device through the slot of the conductive bezel.

4. The mobile device as claimed in claim 1, wherein the feeding element is further directly coupled to a feeding point on the conductive bezel, the feeding point is close to the slot of the conductive bezel, and the antenna structure further comprises the conductive bezel.

5. The mobile device as claimed in claim 1, wherein the feeding element comprises a feeding board and a feeding connection element, the feeding board is close to the slot of the conductive bezel, and the signal source is coupled through the feeding connection element to the feeding board.

6. The mobile device as claimed in claim 5, wherein the feeding connection element is a metal spring or a pogo pin.

7. The mobile device as claimed in claim 5, wherein the feeding board is an FPCB (Flexible Printed Circuit Board).

8. The mobile device as claimed in claim 5, wherein the feeding board is substantially parallel to the conductive bezel, and the feeding connection element is substantially perpendicular to the feeding board.

9. The mobile device as claimed in claim 5, wherein the feeding element is further configured as a monopole antenna independently, wherein the monopole antenna and the antenna structure operate in different bands.

10. The mobile device as claimed in claim 5, wherein the feeding element further comprises a shorting connection element, and the feeding board is further coupled through the shorting connection element to the ground element.

11. The mobile device as claimed in claim 10, wherein the shorting connection element is a metal spring or a pogo pin.

12. The mobile device as claimed in claim 10, wherein the feeding element is further configured as a PIFA (Planar Inverted F antenna) independently, wherein the PIFA and the antenna structure operate in different bands.

13. The mobile device as claimed in claim 1, further comprising:

a dielectric substrate, wherein the ground element is a ground plane disposed on the dielectric substrate, and the ground plane is substantially parallel to the conductive bezel.

14. The mobile device as claimed in claim 1, further comprising:

a coaxial cable, wherein the signal source is coupled through the coaxial cable to the feeding element.

15. The mobile device as claimed in claim 1, further comprising:

a grounding connection element, wherein the conductive bezel is further coupled through the grounding connection element to the ground element, wherein a junction area of the grounding connection element is much smaller than a total area of the conductive bezel and is much smaller than a total area of the ground element.

16. The mobile device as claimed in claim 1, wherein the slot of the conductive bezel has an open end and a closed end.

17. The mobile device as claimed in claim 1, wherein the slot of the conductive bezel has two closed ends.

18. The mobile device as claimed in claim 1, wherein the slot of the conductive bezel substantially has an I-shape.

19. The mobile device as claimed in claim 1, wherein the slot of the conductive bezel substantially has an L-shape.

20. The mobile device as claimed in claim 1, wherein the slot of the conductive bezel is configured to display a company logo.

21. The mobile device as claimed in claim 20, wherein the slot of the conductive bezel comprises a first portion, a second portion, and a third portion, wherein the first portion substantially has an H-shape, the second portion substantially has a T-shape, and the third portion substantially has a C-shape.

22. The mobile device as claimed in claim 1, wherein the antenna structure is excited to generate a GPS (Global Positioning System) band, a Div (Diversity) band, a Bluetooth band, a Wi-Fi band, a WLAN (Wireless Local Area Network) band, and/or a telecommunication protocol band.

23. The mobile device as claimed in claim 1, wherein the feeding element is away from a geometric center of the slot of the conductive bezel.

24. A method for manufacturing a mobile device, comprising the steps of:

providing a ground element;

providing a conductive bezel, wherein the conductive bezel is substantially independent of the ground element, and a slot is formed in the conductive bezel;

affixing a nonconductive layer to the conductive bezel to cover the slot of the conductive bezel; and providing a feeding element, wherein the feeding element is close to the slot of the conductive bezel, the feeding element is coupled to a signal source, and an antenna structure is formed by the feeding element and the slot, wherein both of the feeding element and the conductive bezel are configured to transceive a frequency band.

* * * * *